US006877614B2

(12) United States Patent
Hu

(10) Patent No.: US 6,877,614 B2
(45) Date of Patent: Apr. 12, 2005

(54) SUPPORT RACK ASSEMBLY

(75) Inventor: Ming Hu, Chang Hua Hsien (TW)

(73) Assignee: Cheng Wei Furniture Co., Ltd., Chang Hua Hsien (TW)

( * ) Notice: Subject to any disclaimer, the term of this patent is extended or adjusted under 35 U.S.C. 154(b) by 15 days.

(21) Appl. No.: 10/453,297

(22) Filed: Jun. 3, 2003

(65) Prior Publication Data

US 2004/0245192 A1 Dec. 9, 2004

(51) Int. Cl.[7] ..... A47F 7/08
(52) U.S. Cl. ..... 211/34; 211/35
(58) Field of Search ..... 211/34–37, 113, 211/118, 119.004, 194, 193, 43, 40; 403/353; 248/214, 300, 301

(56) References Cited

U.S. PATENT DOCUMENTS 1,626,399 A * 4/1927 Fischer ..... 211/35
3,237,898 A * 3/1966 Goss ..... 248/478
3,850,303 A * 11/1974 Franklin ..... 211/134
3,870,153 A * 3/1975 Allsop et al. ..... 211/37
3,958,695 A * 5/1976 Allsop et al. ..... 211/37
5,622,272 A * 4/1997 Orlando, Jr. ..... 211/90.01
5,765,697 A * 6/1998 Soong ..... 211/11
5,855,279 A * 1/1999 Klein et al. ..... 211/35
5,894,940 A * 4/1999 Gusdorf et al. ..... 211/35
5,992,647 A * 11/1999 Malik ..... 211/34
6,464,086 B1 * 10/2002 Klein et al. ..... 211/35
2003/0085188 A1 * 5/2003 Klein et al. ..... 211/118
2004/0118791 A1 * 6/2004 Rimback et al. ..... 211/34

* cited by examiner

*Primary Examiner*—Jennifer E. Novosad
(74) *Attorney, Agent, or Firm*—Alan D. Kamrath; Nikolai & Mersereau, P.A.

(57) ABSTRACT

A support rack assembly includes a frame, and two hanging plates each mounted on the frame. The frame includes two side brackets and a plurality of transverse tubes mounted between the two side brackets. Each of the two side brackets has a first connecting portion and a second connecting portion. Thus, the side brackets are combined in a slide-snap manner without having to provide any fixing member to combine the side brackets. In addition, the hanging plate is locked on the frame in a slide-snap manner, so that the hanging plate is combined with the frame rigidly and stably.

14 Claims, 13 Drawing Sheets

SUPPORT RACK ASSEMBLY

BACKGROUND OF THE INVENTION

1. Field of the Invention

The present invention relates to a support rack assembly, and more particularly to a support rack assembly for articles, such as the shoes or the like.

2. Description of the Related Art

A conventional shoe support rack in accordance with the prior art shown in FIGS. 1–3 comprises a frame 20, and two hanging plates 10 each mounted on the frame 20. Each of the two hanging plates 10 is hung on a door plate 30A (see FIG. 3). Each of the two hanging plates 10 is substantially inverted U-shaped, and has a first side formed with a hook 11 hooked on door plate 30A and a second side provided with a snap portion 12 formed with an insertion hole 120. The frame 20 includes two spaced side brackets 21 and a plurality of transverse tubes 22 mounted between the two spaced side brackets 21. Each of the two spaced side brackets 21 of the frame 20 is provided with a plurality of support ribs 213 for supporting the transverse tubes 22. Thus, the frame 20 can be used to support shoes as shown in FIG. 3. Each of the two spaced side brackets 21 of the frame 20 has an upper end formed with a first connecting portion 211 and a lower end formed with a second connecting portion 212. The first connecting portion 211 has a distal end provided with a plug 2110 inserted into the insertion hole 120, so that the first connecting portion 211 is hung on the respective hanging plate 10. The first connecting portion 211 has a top formed with at least one T-shaped transverse slide slot 2111. The second connecting portion 212 of the side bracket 21 has a bottom formed with at least one T-shaped transverse guide block 2120 inserted into the T-shaped slide slot 2111 of the first connecting portion 211 of another side bracket 21, so that multiple side brackets 21 can be combined with each other.

However, the plug 2110 is easily detached from the insertion hole 120, so that the first connecting portion 211 is not combined with the hanging plate 10 rigidly and stably, and the frame 20 easily falls down, thereby causing inconvenience to the user.

SUMMARY OF THE INVENTION

The primary objective of the present invention is to provide a support rack assembly, wherein the side brackets of the frame are combined with each other in a slide-snap manner without having to provide any fixing member to combine the side brackets of the frame.

Another objective of the present invention is to provide a support rack assembly, wherein the hanging plate is locked on the frame in a slide-snap manner, so that the hanging plate is combined with the frame rigidly and stably.

A further objective of the present invention is to provide a support rack assembly, wherein the side brackets of the frame is combined with the two stands in a slide-snap manner, so that the support rack assembly can be disposed at an upright state.

A further objective of the present invention is to provide a support rack assembly, wherein the support plate and the two side brackets form an enclosure to place and store articles, such as books, CD or the like.

In accordance with the present invention, there is provided a support rack assembly, comprising a frame, and two hanging plates each mounted on the frame, wherein:

the frame includes two spaced side brackets and a plurality of transverse tubes mounted between the two spaced side brackets;

each of the two spaced side brackets of the frame has an upper end formed with a first connecting portion and a lower end formed with a second connecting portion;

the first connecting portion of the side bracket has a first section and a second section, the second section is formed with an insertion slot, the insertion slot has a side formed with an extension slot, the extension slot has a bottom having two sides each formed with a locking recess extended upward; and each of the two hanging plates has a vertical section having two sides each formed with a recess.

Further benefits and advantages of the present invention will become apparent after a careful reading of the detailed description with appropriate reference to the accompanying drawings.

DETAILED DESCRIPTION OF THE INVENTION

Figure 1:
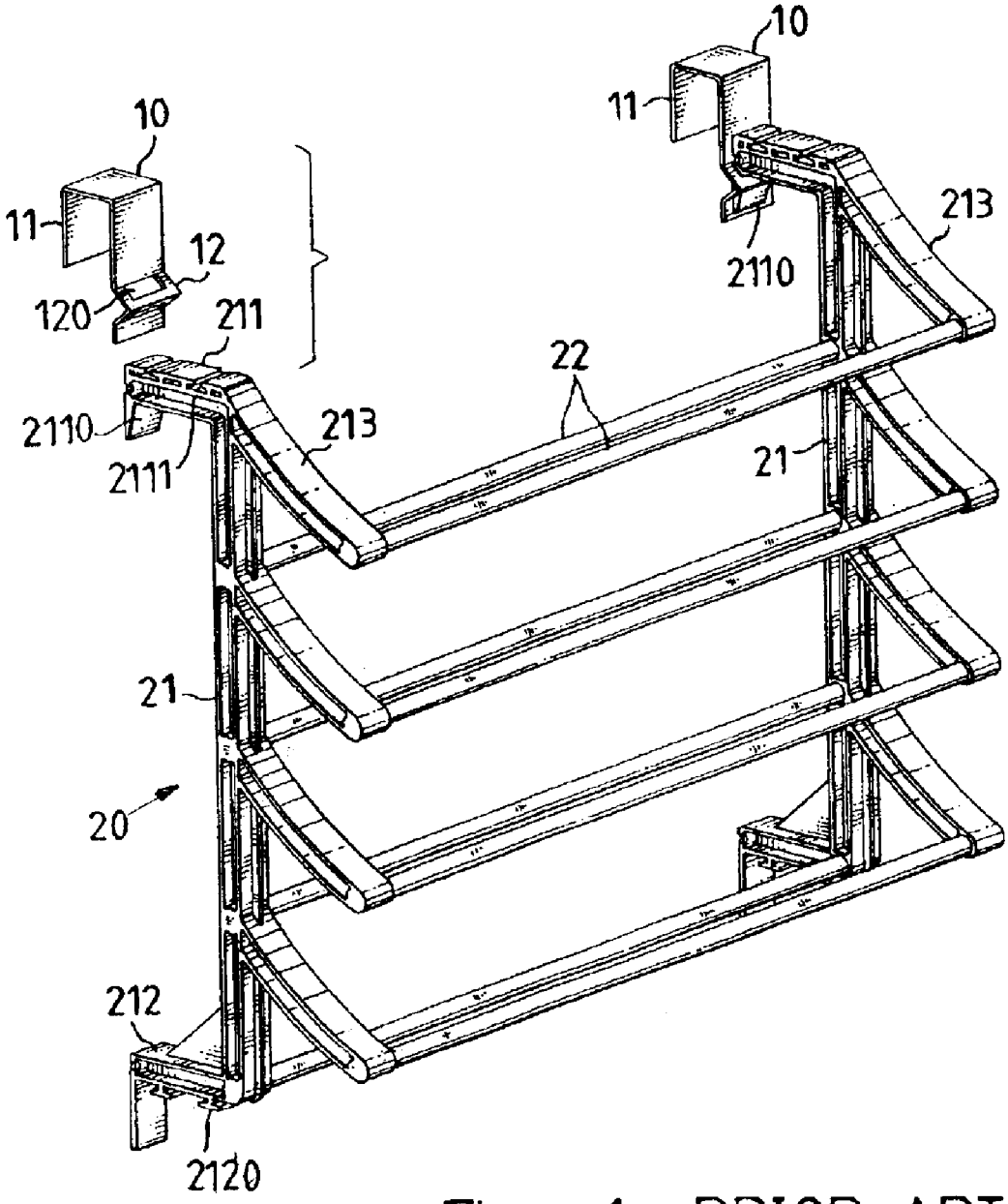
Fig. 1 PRIOR ART
FIG. 1 is a partially exploded perspective view of a conventional support rack in accordance with the prior art.
Figure 2:
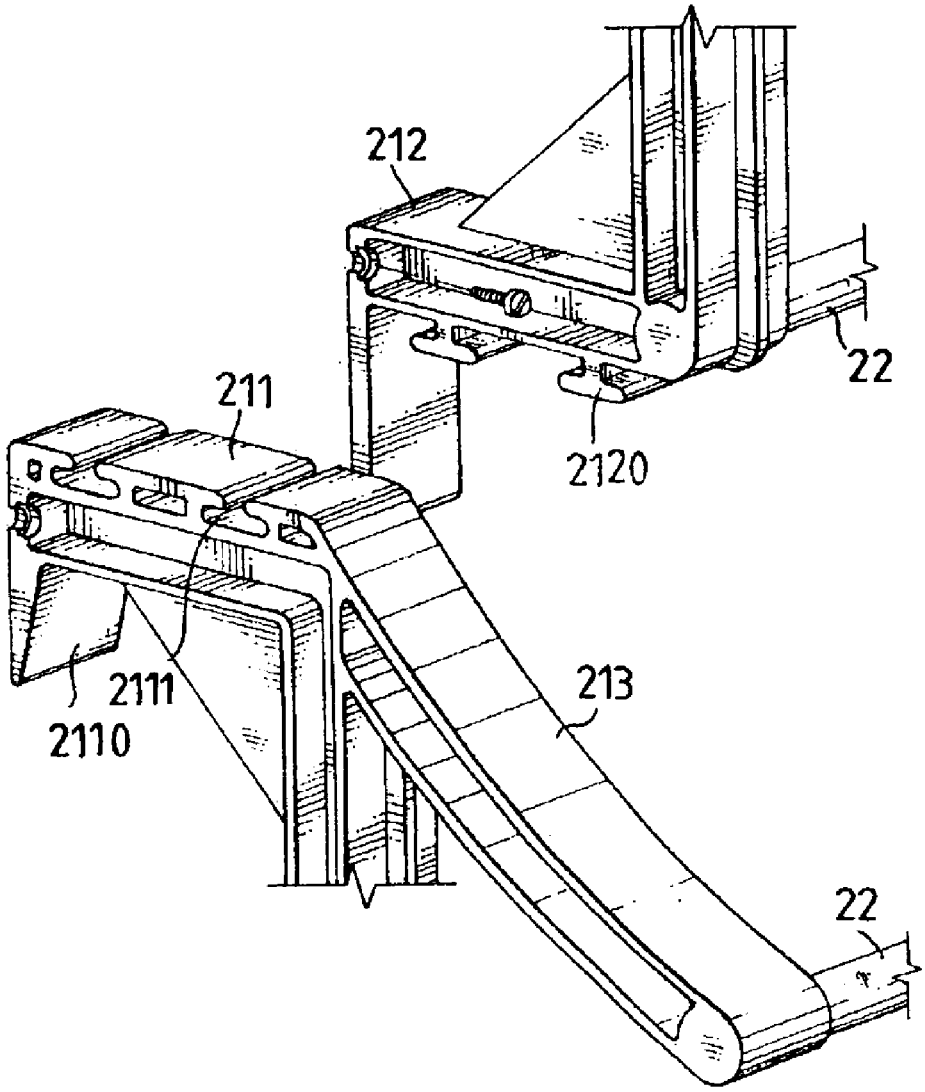
Fig. 2 PRIOR ART
FIG. 2 is a partially exploded perspective view of the conventional support rack in accordance with the prior art.
Figure 3:
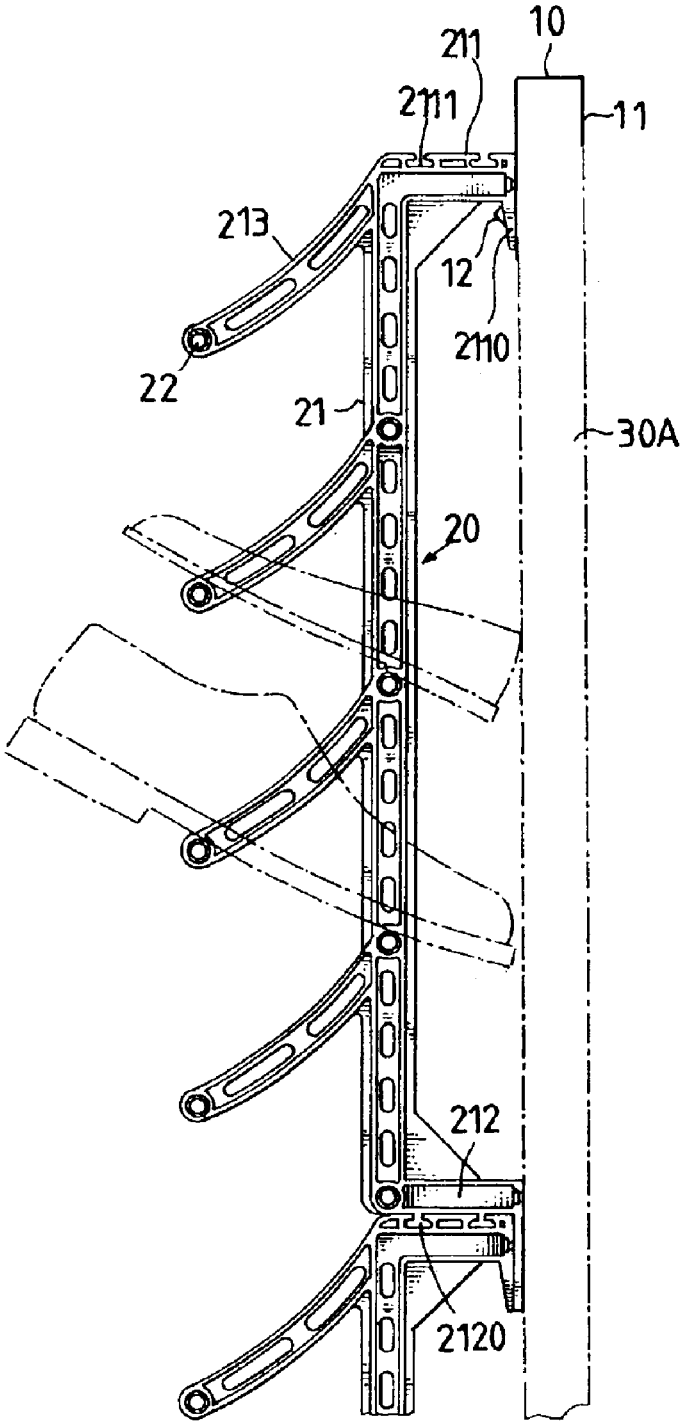
Fig . 3 PRIOR ART
FIG. 3 is a side perspective assembly view of the conventional support rack in accordance with the prior art.
Figure 4:
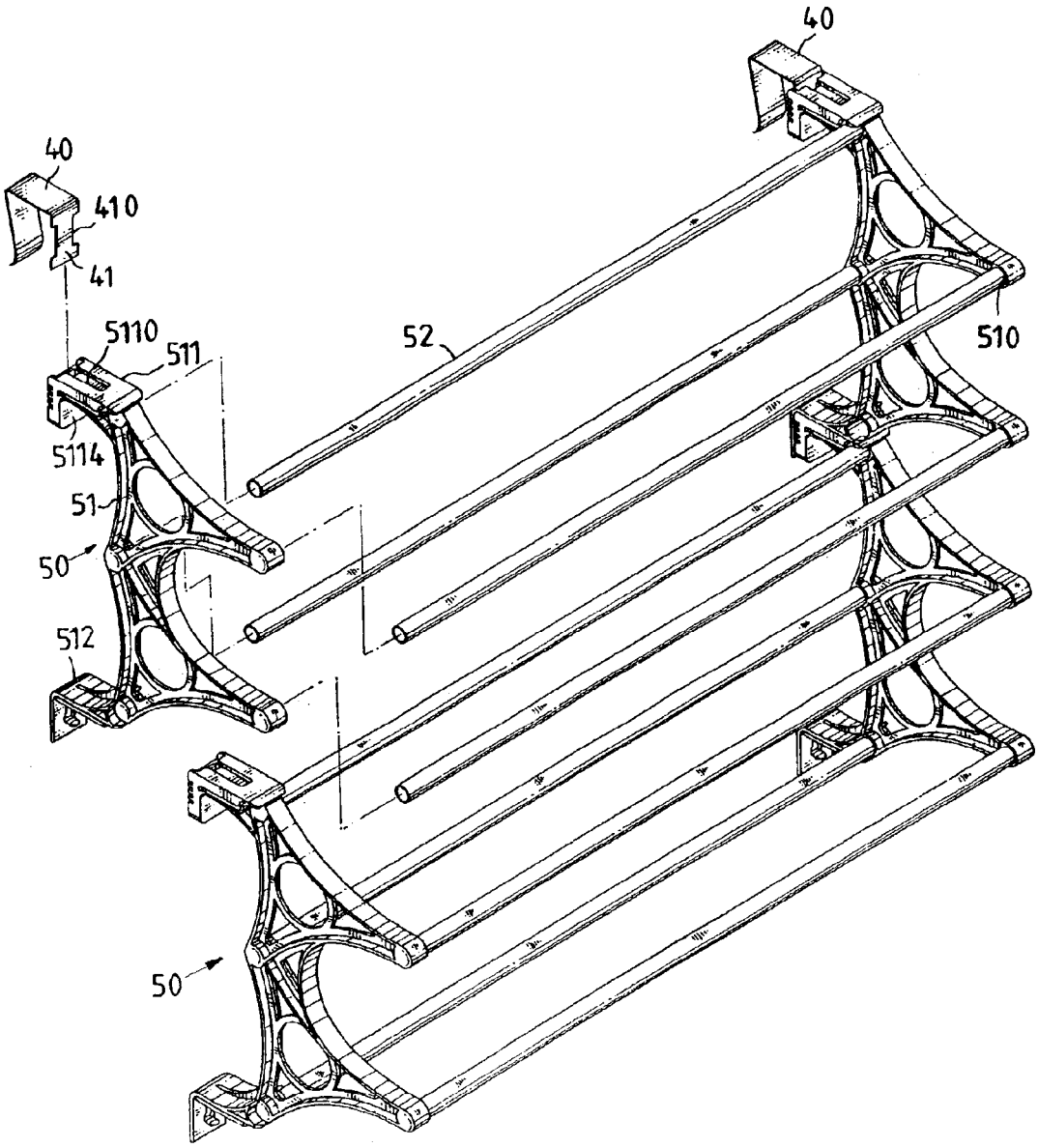
FIG. 4 is a partially exploded perspective view of a support rack assembly in accordance with the preferred embodiment of the present invention.
Figure 5:
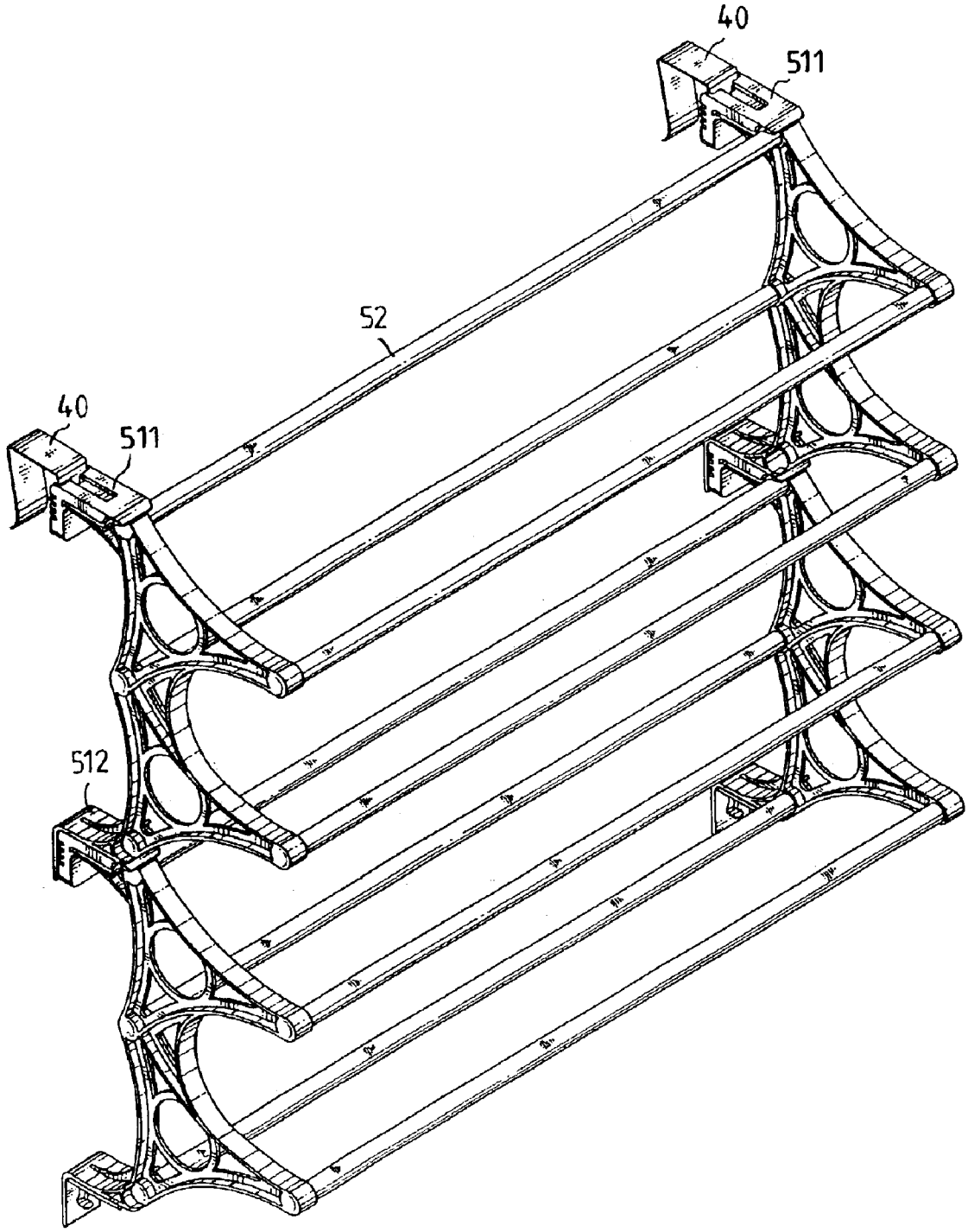
FIG. 5 is a perspective assembly view of the support rack assembly in accordance with the preferred embodiment of the present invention.

Referring to the drawings and initially to FIGS. 4–7, a support rack assembly in accordance with the preferred embodiment of the present invention comprises a frame 50, and two hanging plates 40 each mounted on the frame 50.

Figure 12:
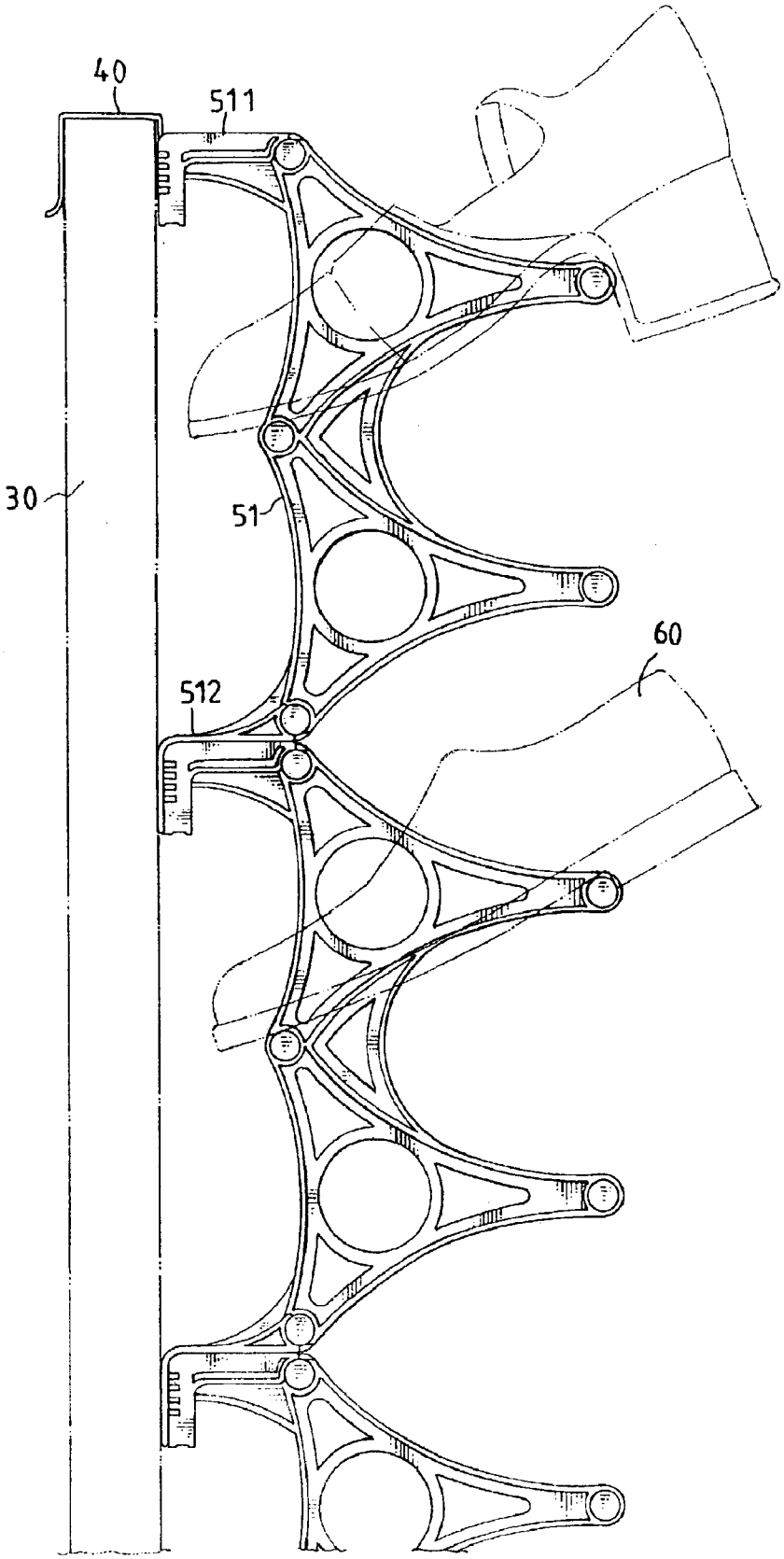
FIG. 12 is a side plan view of the support rack assembly as shown in FIG. 5.

Each of the two hanging plates 40 is hung on a door plate 30 (see FIG. 12). Each of the two hanging plates 40 is substantially inverted U-shaped, and has a side formed with a vertical section 41. The vertical section 41 of each of the two hanging plates 40 is substantially I-shaped, and has two sides each formed with a recess 410.

The frame 50 includes two spaced side brackets 51 and a plurality of transverse tubes 52 mounted between the two spaced side brackets 51. Thus, the frame 50 can be used to support shoes 60 as shown in FIG. 12.

Each of the two spaced side brackets 51 of the frame 50 has an inner side formed with a plurality of insertion holes 510, and each of the transverse tubes 52 has two ends each inserted into a respective one of the insertion holes 510.

Each of the two spaced side brackets 51 of the frame 50 has an upper end formed with an inverted L-shaped first connecting portion 511 and a lower end formed with an inverted L-shaped second connecting portion 512.

Figure 6:
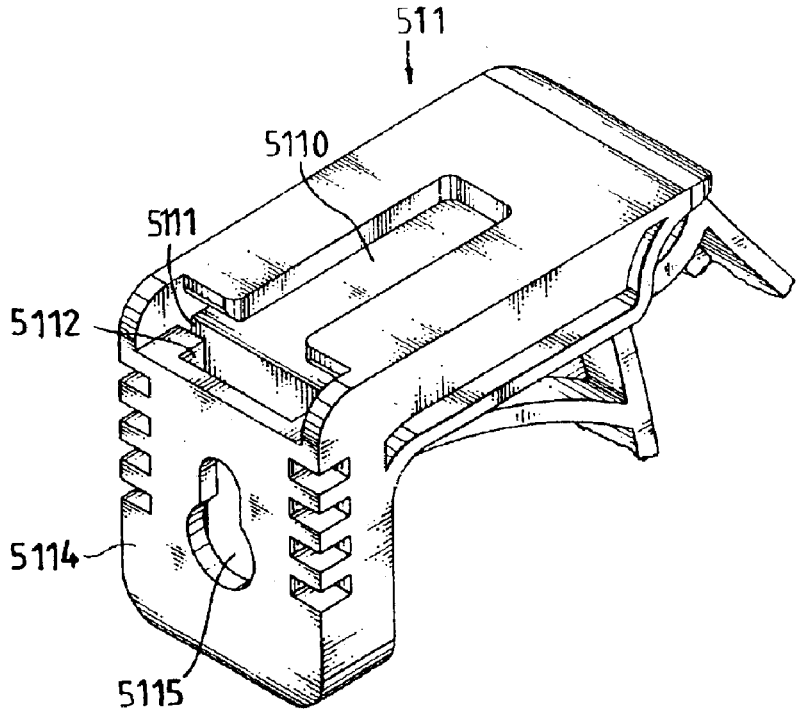
FIG. 6 is a perspective view of a first connecting portion of the support rack assembly in accordance with the preferred embodiment of the present invention.
Figure 7:
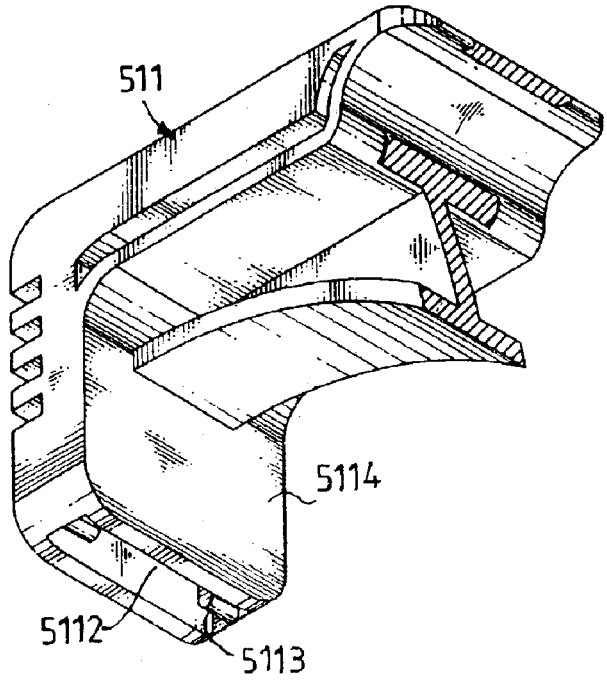
FIG. 7 is a perspective view of the first connecting portion of the support rack assembly in accordance with the preferred embodiment of the present invention.

As shown in FIGS. 6 and 7, the first connecting portion 511 of the side bracket 51 has a first section formed with a longitudinally arranged T-shaped slide slot 5110 and a second section 5114 formed with an insertion slot 5111 communicating with the slide slot 5110. The insertion slot 5111 has a side formed with an extension slot 5112 having a width smaller than that of the insertion slot 5111. The extension slot 5112 has a bottom having two sides each formed with a locking recess 5113 which is extended upward and in parallel with the insertion slot 5111. In addition, the second section 5114 of the first connecting portion 511 is formed with a first snap hole 5115.

Figure 8:
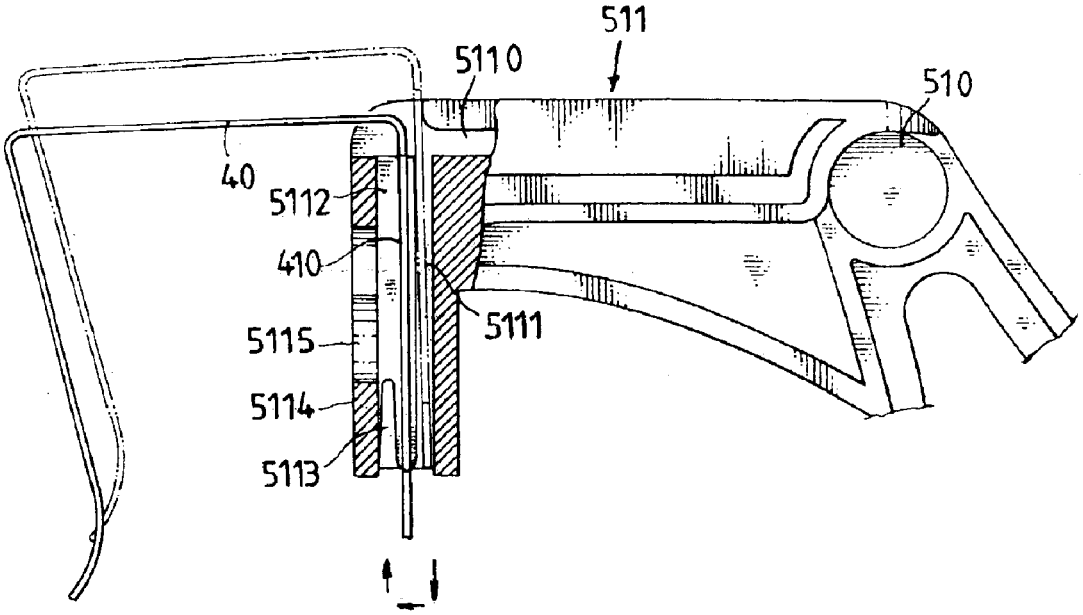
FIG. 8 is a partially cut-away side plan cross-sectional view of the support rack assembly as shown in FIG. 5.
Figure 9:
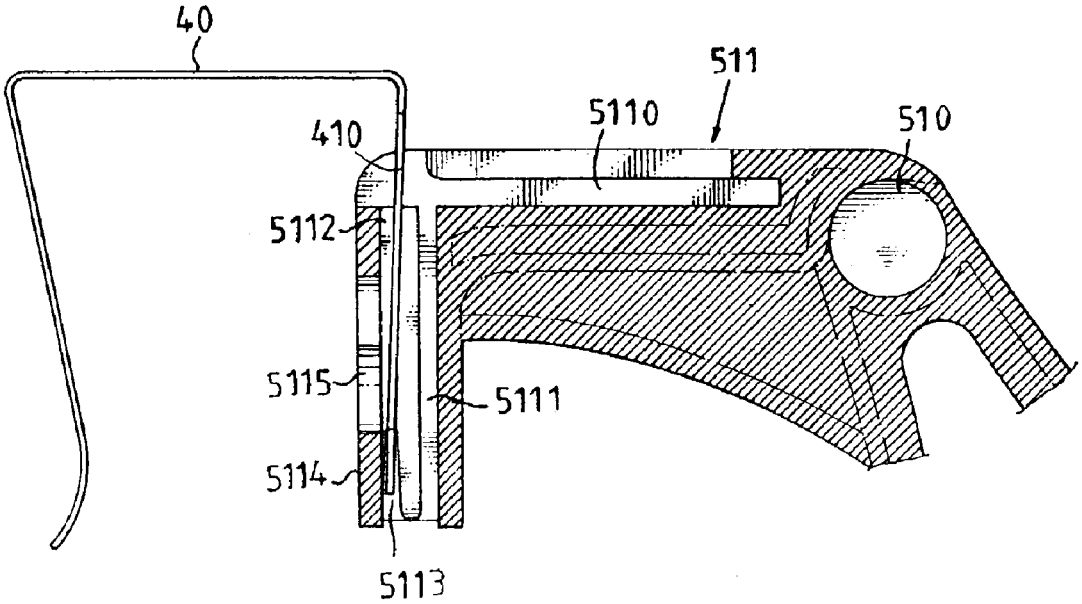
FIG. 9 is a schematic operational view of the support rack assembly as shown in FIG. 8 in assembly.

As shown in FIGS. 8 and 9, after the vertical section 41 of the hanging plate 40 is inserted into the insertion slot 5111 of the respective first connecting portion 511, the recess 410 of the vertical section 41 of the hanging plate 40 is extended into the extension slot 5112 of the insertion slot 5111. Then, the vertical section 41 of the hanging plate 40 is pulled upward, so that the bottom of the vertical section 41 of the hanging plate 40 is snapped into the locking recess 5113 of the extension slot 5112, thereby locking the vertical section 41 of the hanging plate 40 on the respective first connecting portion 511 of the frame 50, so that the hanging plate 40 is combined with the frame 50 rigidly and stably.

Figure 10:
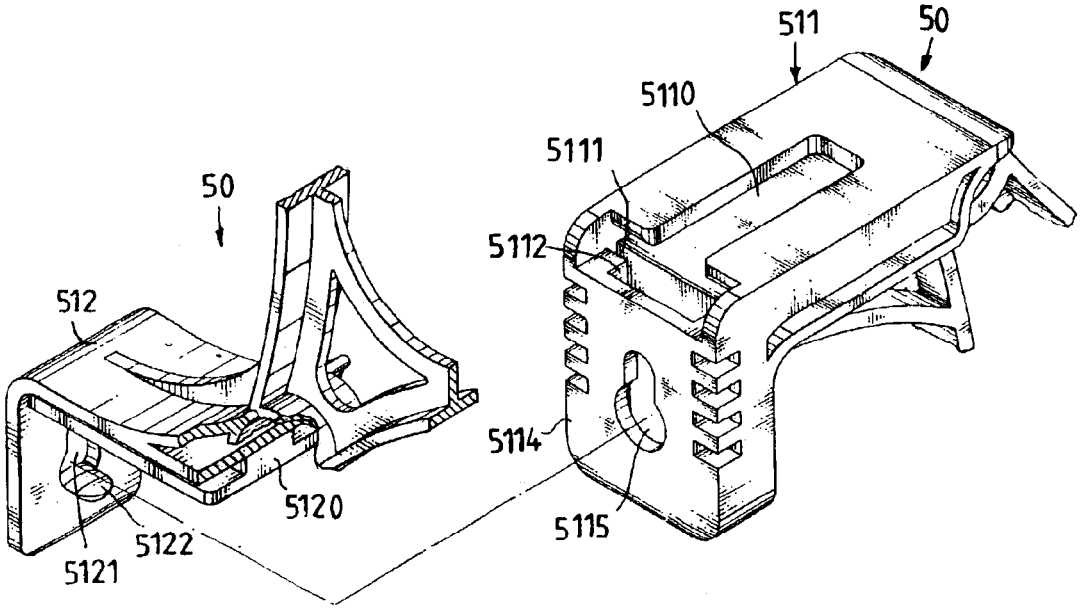
FIG. 10 is a partially exploded perspective view of the support rack assembly in accordance with the preferred embodiment of the present invention.
Figure 11:
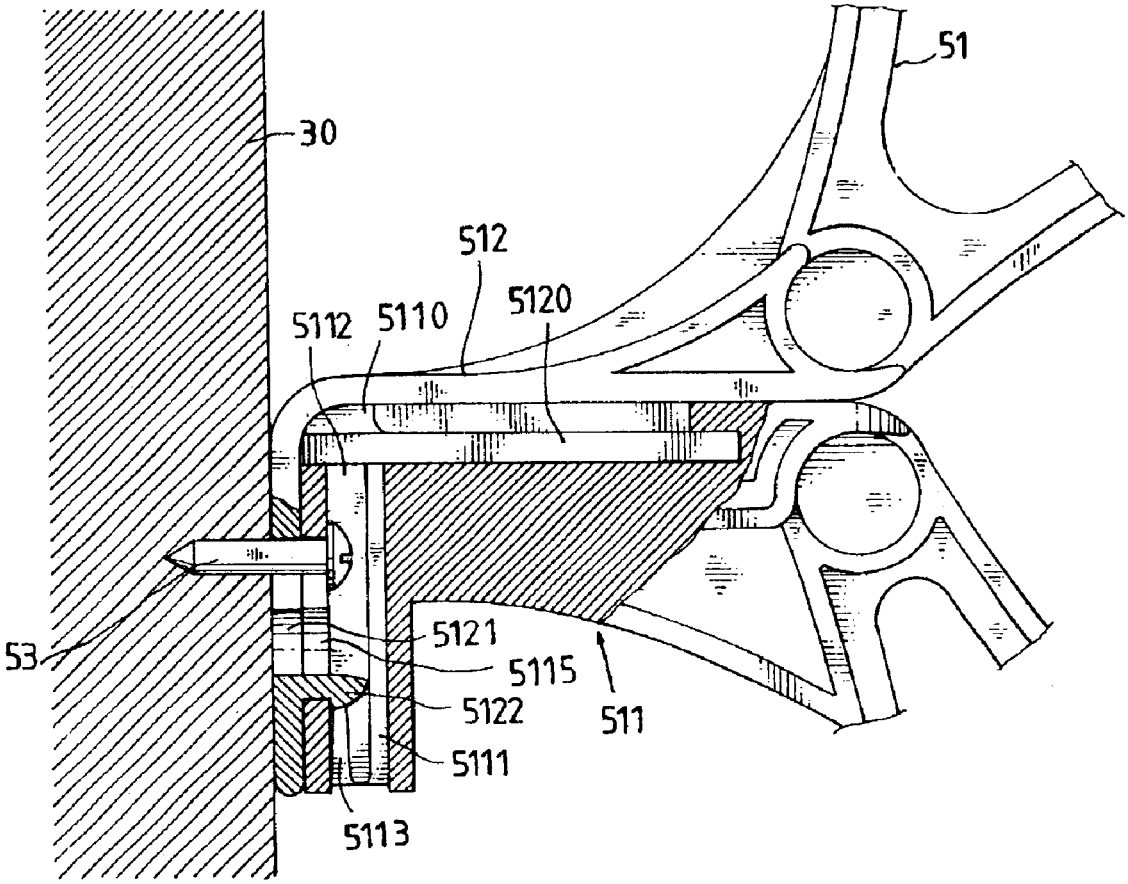
FIG. 11 is a side plan cross-sectional assembly view of the support rack assembly as shown in FIG. 10.

As shown in FIGS. 10 and 11, the second connecting portion 512 of the side bracket 51 has a first section having a bottom provided with a longitudinally arranged T-shaped guide block 5120 inserted into the T-shaped slide slot 5110 of the first connecting portion 511 of another side bracket 51. In addition, the second connecting portion 512 of the side bracket 51 has a second section formed with a second snap hole 5121 aligning with the first snap hole 5115 of another side bracket 51. The second snap hole 5121 has a bottom provided with an elastic protruding snap block 5122 snapped on a bottom of the first snap hole 5115 of another side bracket 51, so that multiple side brackets 51 can be combined with each other.

The support rack assembly further comprises a plurality of fixing members 53 (such as rivets) each extended through the first snap hole 5115 of the side bracket 51 and the second snap hole 5121 of another side bracket 51 and inserted into the door plate 53, so that the combined side brackets 51 are fixed on the door plate 53 as shown in FIG. 11.

Figure 13:
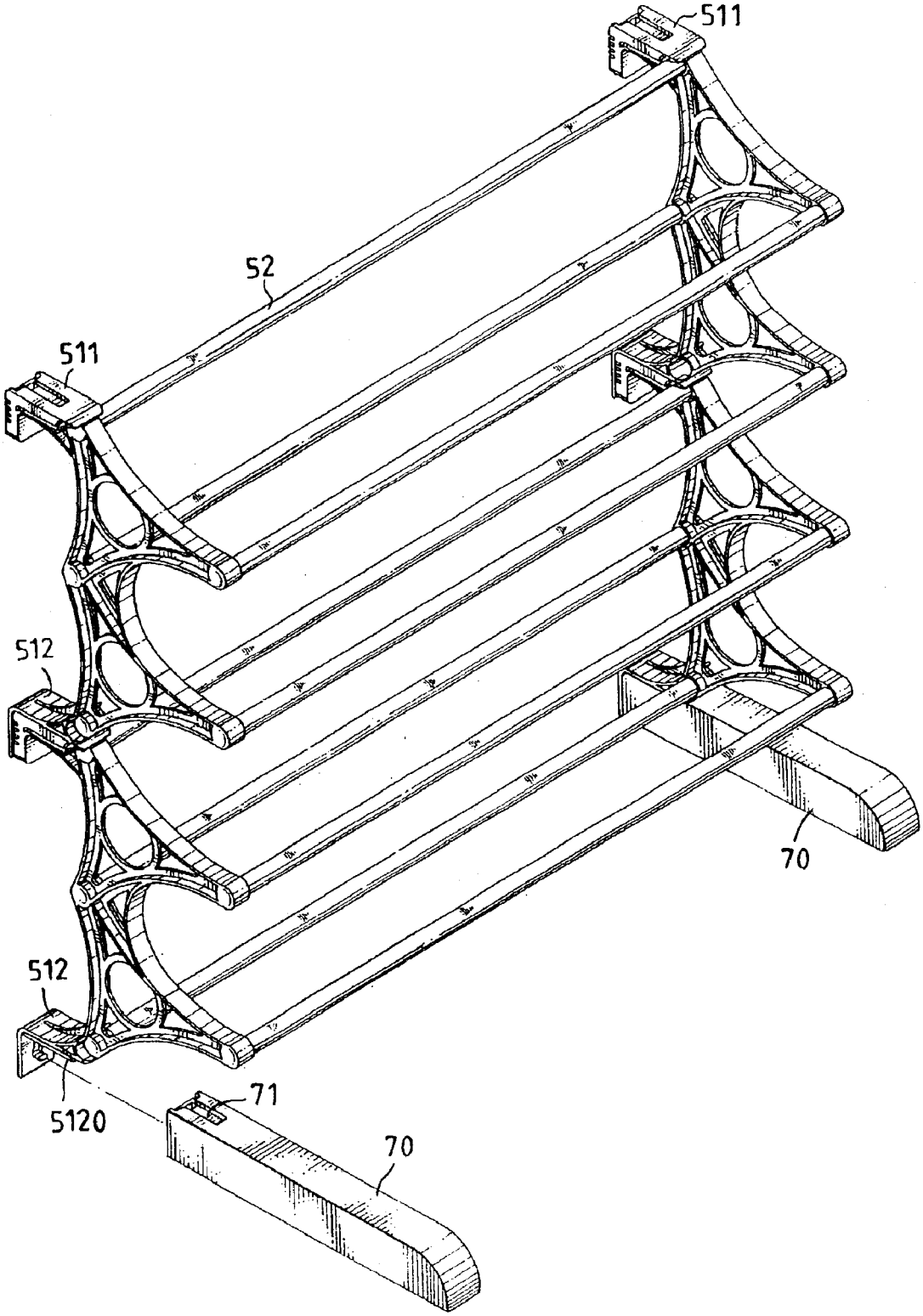
FIG. 13 is a partially exploded perspective view of a support rack assembly in accordance with another embodiment of the present invention.

As shown in FIG. 13, the support rack assembly further comprises two stands 70 each having an end formed with a longitudinally arranged T-shaped slide slot 71. The T-shaped guide block 5120 of the second connecting portion 512 of the side bracket 51 is inserted into the T-shaped slide slot 71 of the respective stand 70, so that the frame 50 is combined with the two stands 70.

Figure 14:
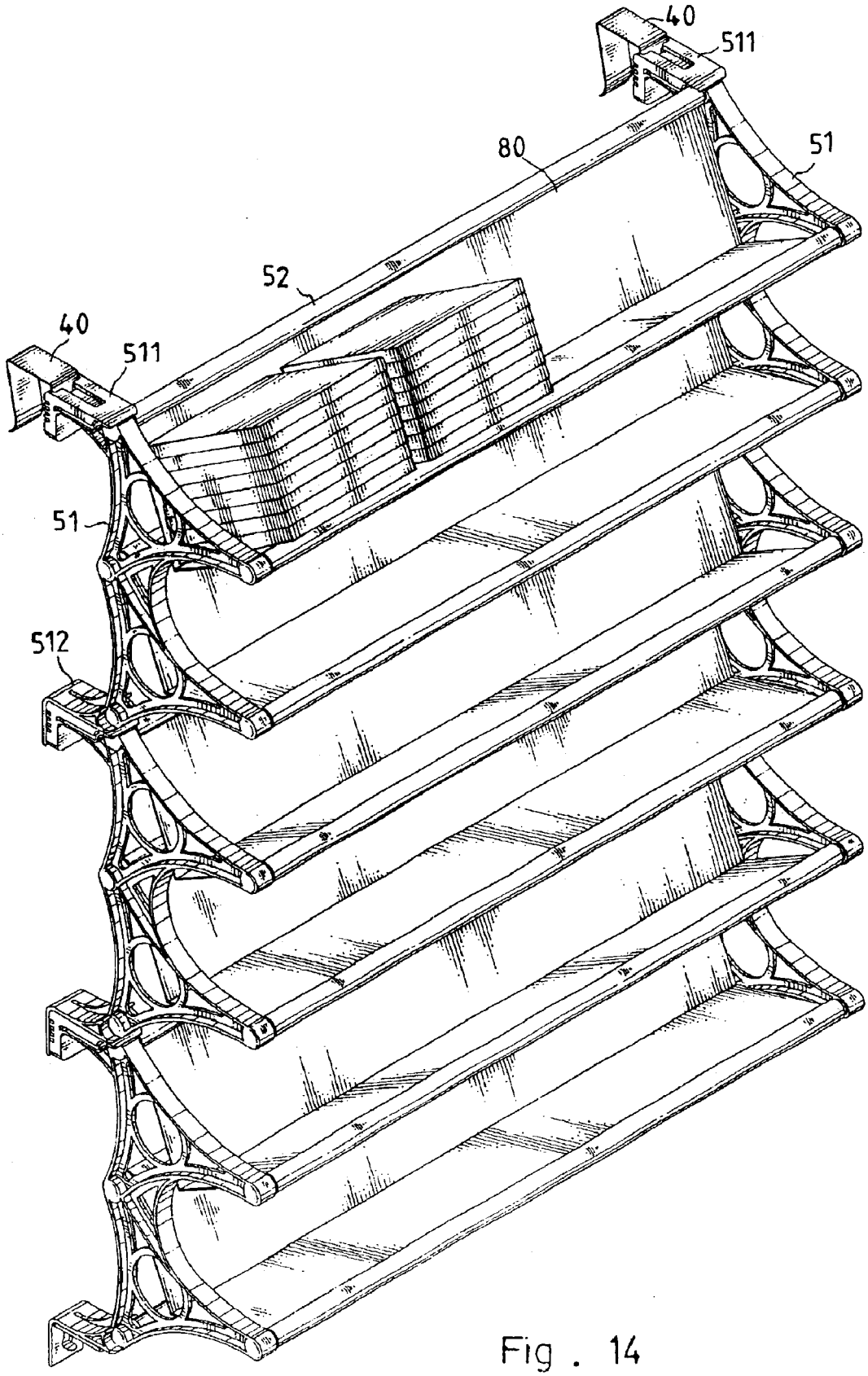
FIG. 14 is a perspective assembly view of a support rack assembly in accordance with another embodiment of the present invention.

As shown in FIG. 14, the support rack assembly further comprises an L-shaped support plate 80 mounted between the transverse tubes 52, so that the support plate 80 and the two side brackets 51 form an enclosure to place and store articles, such as books, CD or the like.

Figure 15:
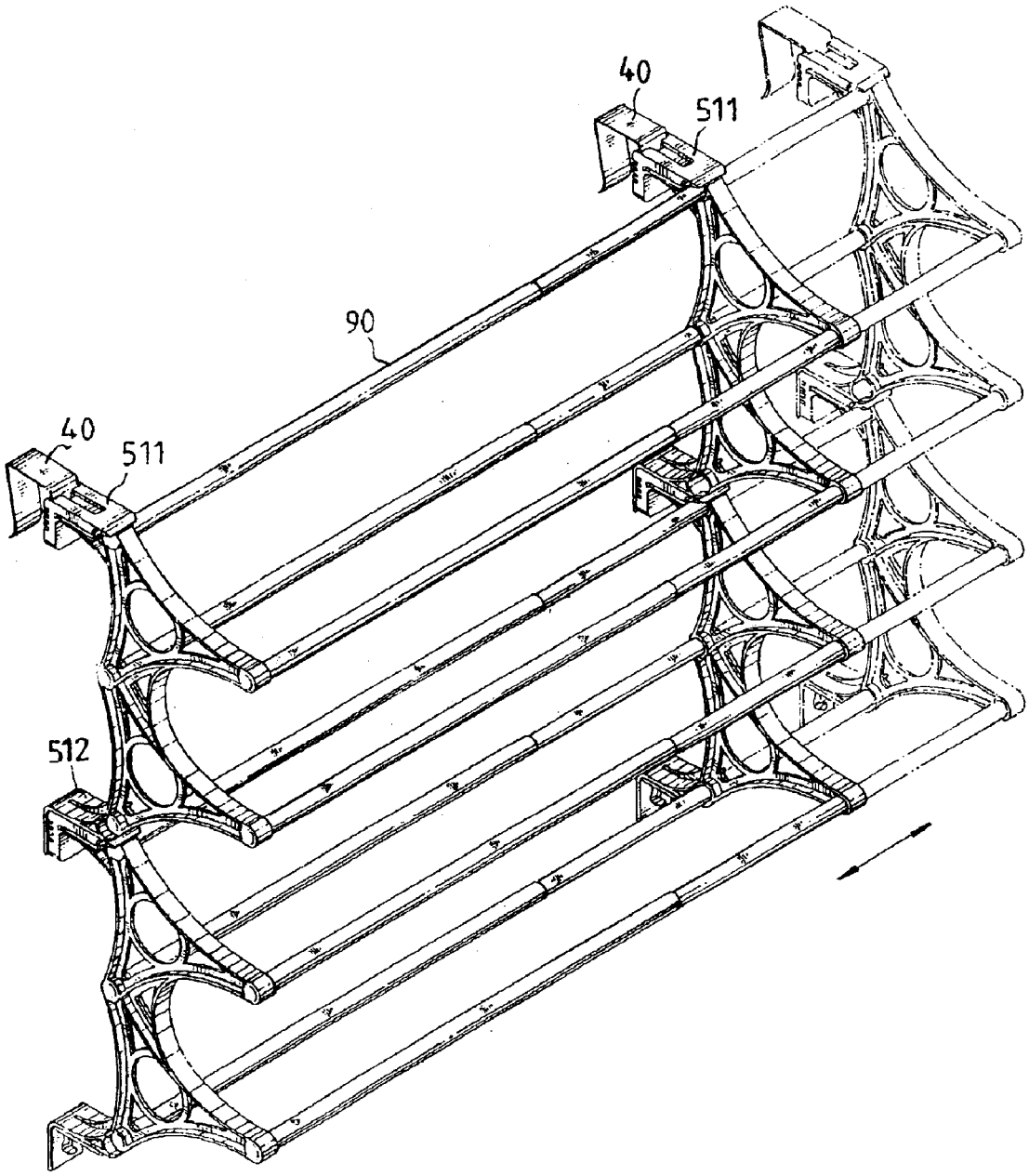
FIG. 15 is a perspective assembly view of a support rack assembly in accordance with another embodiment of the present invention.

As shown in FIG. 15, each of the transverse tubes 52 is replaced by a retractable tube 90.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A support rack assembly, comprising a frame, and two hanging plates each mounted on the frame, wherein:

the frame includes two spaced side brackets and a plurality of transverse tubes mounted between the two spaced side brackets;

each of the two spaced side brackets of the frame has an upper end formed with a first connecting portion and a lower end formed with a second connecting portion;

the first connecting portion of the side brackets has a first section and a second section, the second section is formed with an insertion slot, the insertion slot has a side formed with an extension slot, the extension slot has a bottom having two sides each formed with a locking recess extended upward;

each of the two hanging plates has a vertical section having two sides each formed with a recess;

the vertical section of each of the two hanging plates is inserted into the insertion slot of the respective first connecting portion;

the recess of the vertical section of each of the two hanging plates is extended into the extension slot of the insertion slot;

the bottom of the vertical section of the hanging plate is snapped into the locking recess of the extension slot, thereby locking the vertical section of each of the two hanging plates on the respective first connecting portion of the frame, so that each of the two hanging plates is combined with the frame.

2. The support rack assembly in accordance with claim 1, wherein each of the two spaced side brackets of the frame has an inner side formed with a plurality of insertion holes, and each of the transverse tubes has two ends each inserted into a respective one of the insertion holes.

3. The support rack assembly in accordance with claim 1, wherein the first connecting portion is substantially inverted L-shaped.

4. The support rack assembly in accordance with claim 1, wherein the second connecting portion is substantially inverted L-shaped.

5. The support rack assembly in accordance with claim 1, wherein the extension slot has a width smaller than that of the insertion slot.

6. The support rack assembly in accordance with claim 1, wherein the locking recesses are in parallel with the insertion slot.

7. The support rack assembly in accordance with claim 1, further comprising an L-shaped support plate mounted between the transverse tubes, so that the support plate and the two side brackets form an enclosure.

8. The support rack assembly in accordance with claim 1, wherein each of the transverse tubes is a retractable tube.

9. The support rack assembly in accordance with claim 1, wherein each of the two hanging plates is substantially inverted U-shaped.

10. The support rack assembly in accordance with claim 1, wherein the vertical section of each of the two hanging plates is substantially L-shaped.

11. A support rack assembly, comprising a frame, and two hanging plates each mounted on the frame, wherein:

the frame includes two spaced side brackets and a plurality of transverse tubes mounted between the two spaced side brackets;

each of the two spaced side brackets of the frame has an upper end formed with a first connect portion and a lower end formed with a second connecting portion;

the first connecting portion of the side brackets has a first section and a second section, the second section is formed with an insertion slot, the insertion slot has a side formed with an extension slot, the extension slot has a bottom having two sides each formed with a locking recess extended upward;

each of the two hanging plates has a vertical section having two sides each formed with a recess;

the second section of the first connecting portion is formed with a first snap hole, the second connecting portion of the side brackets has a second section formed with a second snap hole aligning with the first snap hole of another side bracket, and the second snap hole has a bottom provided with an elastic protruding snap block snapped on a bottom of the first snap hole of another side bracket, so that multiple side brackets can be combined with each other.

12. The support rack assembly in accordance with claim 11, further comprising a plurality of fixing members each extended through the first snap hole of the side bracket and the second snap hole of another side bracket.

13. A support rack assembly, comprising a frame, and two hanging plates each mounted on the frame, wherein:

the frame includes two spaced side brackets and a plurality of transverse tubes mounted between the two spaced side brackets;

each of the two spaced side brackets of the frame has an upper end formed with a first connecting portion and a lower end formed with a second connecting portion;

the first connecting portion of the side brackets has a first section and a second section, the second section is formed with an insertion slot, the insertion slot has a side formed with an extension slot, the extension slot has a bottom having two sides each formed with a locking recess extended upward;

each of the two hanging plates has a vertical section having two sides each formed with a recess;

the second connecting portion of the side brackets has a first section having a bottom provided with a longitudinally arranged T-shaped guide block;

the first section of the first connecting portion is formed with a longitudinally arranged T-shaped slide slot, and the T-shaped guide block of the second connecting portion of the side bracket is inserted into the T-shaped slide slot of the first connecting portion of another side bracket.

14. The support rack assembly in accordance with claim 13, further comprising two stands each having an end formed with a longitudinally arranged T-shaped slide slot, wherein the T-shaped guide block of the second connecting portion of the side brackets is inserted into the T-shaped slide slot of the respective stand, so that the frame is combined with the two stands.

* * * * *